United States Patent [19]

Wardle

[11] 3,990,386

[45] Nov. 9, 1976

[54] FAIRED MULTI-STRENGTH MEMBER TOWCABLE AND ASSOCIATED SEQUENTIAL LOAD DISTRIBUTION SYSTEM

[75] Inventor: William F. Wardle, Mystic, Conn.

[73] Assignee: The United States of America as represented by the Secretary of the Navy, Washington, D.C.

[22] Filed: May 23, 1975

[21] Appl. No.: 580,436

[52] U.S. Cl. ..... 114/235 F; 254/190 R

[51] Int. Cl.[2] ..... B63B 21/56

[58] Field of Search ..... 254/135 R, 190 R, 173 R; 114/235 F, 66.5 F, 235 R; 91/411 R; 340/7 PC, 7 R

[56] References Cited

UNITED STATES PATENTS

| | | | |
|---|---|---|---|
| 3,176,646 | 4/1965 | Natwick et al. | 114/235 F |
| 3,343,516 | 9/1967 | Nichols et al. | 114/235 F |
| 3,593,619 | 7/1971 | Albrecht | 91/411 R |
| 3,677,009 | 7/1972 | Thatcher | 91/411 R |
| 3,688,607 | 9/1972 | Marlow | 91/411 R |

*Primary Examiner*—Robert J. Spar
*Assistant Examiner*—Kenneth Noland
*Attorney, Agent, or Firm*—Richard S. Sciascia; Arthur A. McGill; Prithvi C. Lall

[57] ABSTRACT

A towing system has a faired multi-strength member towcable and an associated load distribution system. The load distribution system has a plurality of hydraulic cylinders, rods, springs, frames and check valves operating in conjunction with each other such that small tensile loads are applied to one or a small number of strength members. If the load increases additional strength members are sequentially loaded to distribute the applied force.

5 Claims, 6 Drawing Figures

FAIRED MULTI-STRENGTH MEMBER TOWCABLE AND ASSOCIATED SEQUENTIAL LOAD DISTRIBUTION SYSTEM

STATEMENT OF GOVERNMENT INTEREST

The invention described herein maybe manufactured and used by or for the Government of the United States of America for governmental purposes without the payment of any royalties thereon or therefore.

BACKGROUND OF THE INVENTION

The present invention generally relates to towcables and more particularly to a system for distributing a tensile load within a towcable system.

Existing faired towcables utilize a single strength member so positioned within the fairing that the center of tension is sufficiently forward of the center of pressure and center of mass as to insure hydro-mechanical stability. In some cases the strength member comprises a cable of circular cross-section about which the fairing rotates. In other cases the strength member is molded so that its cross-sectional shape forms the fore portion of the fairing. An attached non-strength member tail section completes the towcable. Of course in the latter case the strength member rotates with the towcable.

A circular strength member is not compatible with a low-drag fairing cross-sectional shape because the nose section of a low-drag fairing is too narrow for the installation of an adequate size strength member. The usual practice is to use a non-optimum fairing where a portion of the fairing sides are straight and parallel and where the fairing pivots about a forward mounted circular strength member. The fairing's leading edge is usually determined by a U-shaped piece which surrounds the circular strength member and is fastened to the remaining portion of the fairing. Thus the use of a circular strength member results in both a low percentage of the fairing being occupied by a strength member and a poor drag coefficient.

A molded strength member can constitute the fore section of a low-drag fairing but any attempt to achieve a high packing density results in an undesirably high thickness to width ratio. A high thickness to width ratio can significantly increase the following negative factors. There is difficulty in keeping the center of tension sufficiently far forward even in a straight cable. The center of tension moves aft when the leading edge of a towcable is bent about a lateral axis. When similarly bent the highest tensional stress occurs in the portion of the strength member furthest from the bending center. The stress in this aft edge of the strength member is porportional to the fourth power of the strength member's thickness. In addition when similarly bent the strength member and thus the complete fairing tends to buckle laterally and assume an angle of attack with respect to the relative waterflow.

Some existing faired towcables, particulary the older towcables, devote a considerable portion of their internal space to electrical cables. This situation existed primarily because the signal from or to each transducer or hydrophone element would have its own circuit hard wired in a multiconductor cable. However, data telemetry systems involving frequency multiplexing and coaxial cables exist which can and do provide very large bandwidth channels in relatively small cables. Since the power and data channels are usually not in use simultaneously, properly designed electrical cables and switching and conversion techniques can make one cable serve for both power and data transmission. Thus, if modern power and data transmission techniques are employed space requirements for electrical cables can be minimized.

SUMMARY OF THE INVENTION

Accordingly, it is a general purpose and object of the present invention to provide an improved load distribution system and an improved faired towcable. It is a further object to produce a faired sonar towcable that can better accomodate the impulse type loads caused by high sea states, handling accidents, etc. It is a further objective to achieve this purpose without incurring penalties such as an increase in hydro dynamic drag. Other objectives are that the system should be rugged, relatively light in weight and low in cost. These and other objects of the invention and the various features and details of construction and operation will become apparent from the specification and drawings.

This is accomplished in accordance with the present invention by providing a system with a faired multi-strength member towcable and an associated load distribution mechanism. A number of parallelly positioned strength-members occupy approximately the fore portion of the towcable. As a gradually increasing load is applied to the system, the entire load is as first taken by a single or small number of the forward strength-members. As the load is increased, a hydraulic switching mechanism sequentially transfers the load to the remaining strength members. When all strength members are utilized, a further increase in load is equally distributed among all strength members.

DESCRIPTION OF THE PREFERRED EMBODIMENT

Figure 1:
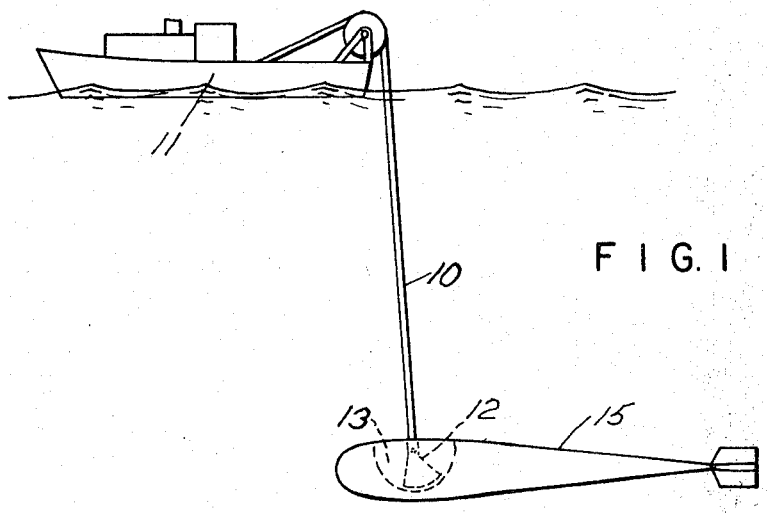
FIG. 1 is a view of the present invention when utilized in conjunction with a typical towed sonar body.

Referring now to FIG. 1 there is shown a faired towcable 10 extending from the aft end of a vessel 11. The towcable 10 connects to a load distribution mechanism 12 within a cavity 13 of a towed body 15. The towed body normally contains sonar equipment for detection purposes.

Figure 2:
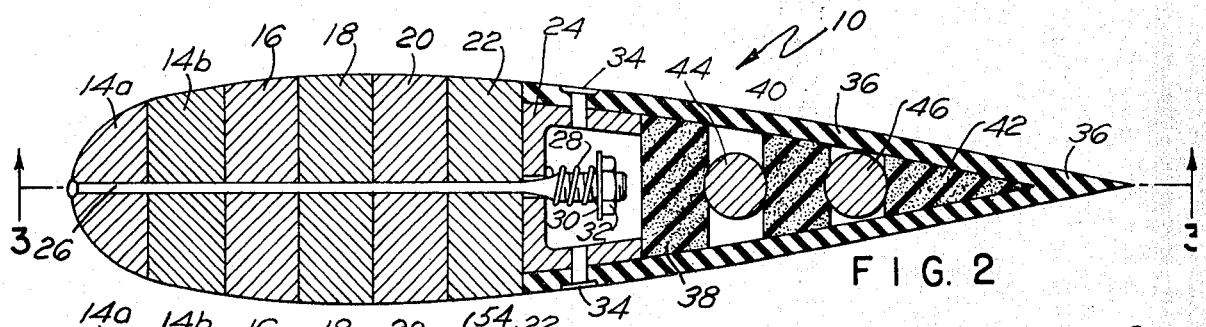
FIG. 2 is a top sectional view of the towcable of FIG. 1.

In FIG. 2 there is shown a top sectional view of the towcable 10 with a plurality of strength members **14*a*, 14*b*, 16, 18, 20 and 22 located at the forward portion of the cable 10. These strength members are narrow and may be made of steel, fiberglas, carbon fibre composites or other well known materials. The material should be chosen to withstand a salt water environment or otherwise the towcable 10 or individual strength members should be jacketed. The strength members can be of materials of varying density with the aft strength members of lighter density than the forward members to place the center of mass in a more forward position. A lubricant film is placed between adjacent surfaces of the members 14***a*, 14*b*, 16, 18, 20 and 22 for ease in the members sliding in relationship to each other. The surface of the strength members in contact with one another should be chosen such that a low coefficient of friction exists between adjacent surfaces.

A U-channel 24 abuts member 22 for holding the strength members in place. A rod 26 having a head at the forward end passes through slots in members 14*a*, 14*b*, 16, 18, 20 and 22. The rod 26 is held in place by means of spring 28, washer 30 and nut 32. Machine screws 34 connect U-channel 24 to a segmented housing 36. Segmented spacers 38, 40 and 42 position electrical cables 44 and 46 within the towcable 10 tail portion.

Figure 3:
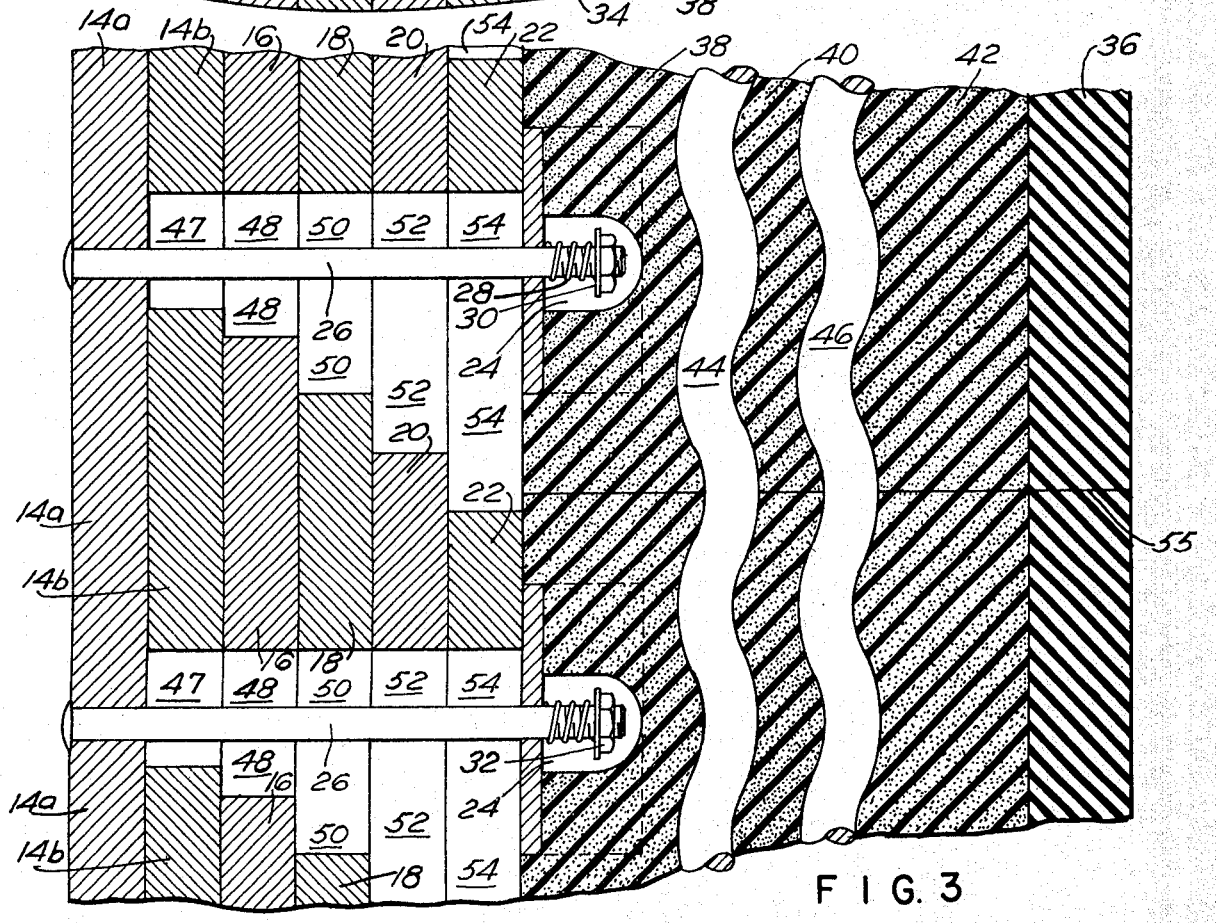
FIG. 3 is a sectional view along the lines 3—3 of FIG. 2 as the towcable extends into the water.

FIG. 3 is a view of towcable 10 along 3—3 of FIG. 2. It is to be noted that there are a plurality of rods 26 and associated components. In addition strength members 16, 18, 20 and 22 have respective elongated slots 48, 50, 52 and 54 for sliding upward and downward upon the flexing of the towcable 10. Spacings 55 in the tail section of towcable 10 show that the housing 36 and spacers 38, 40 and 42 are segmented.

Figures 4, 5:
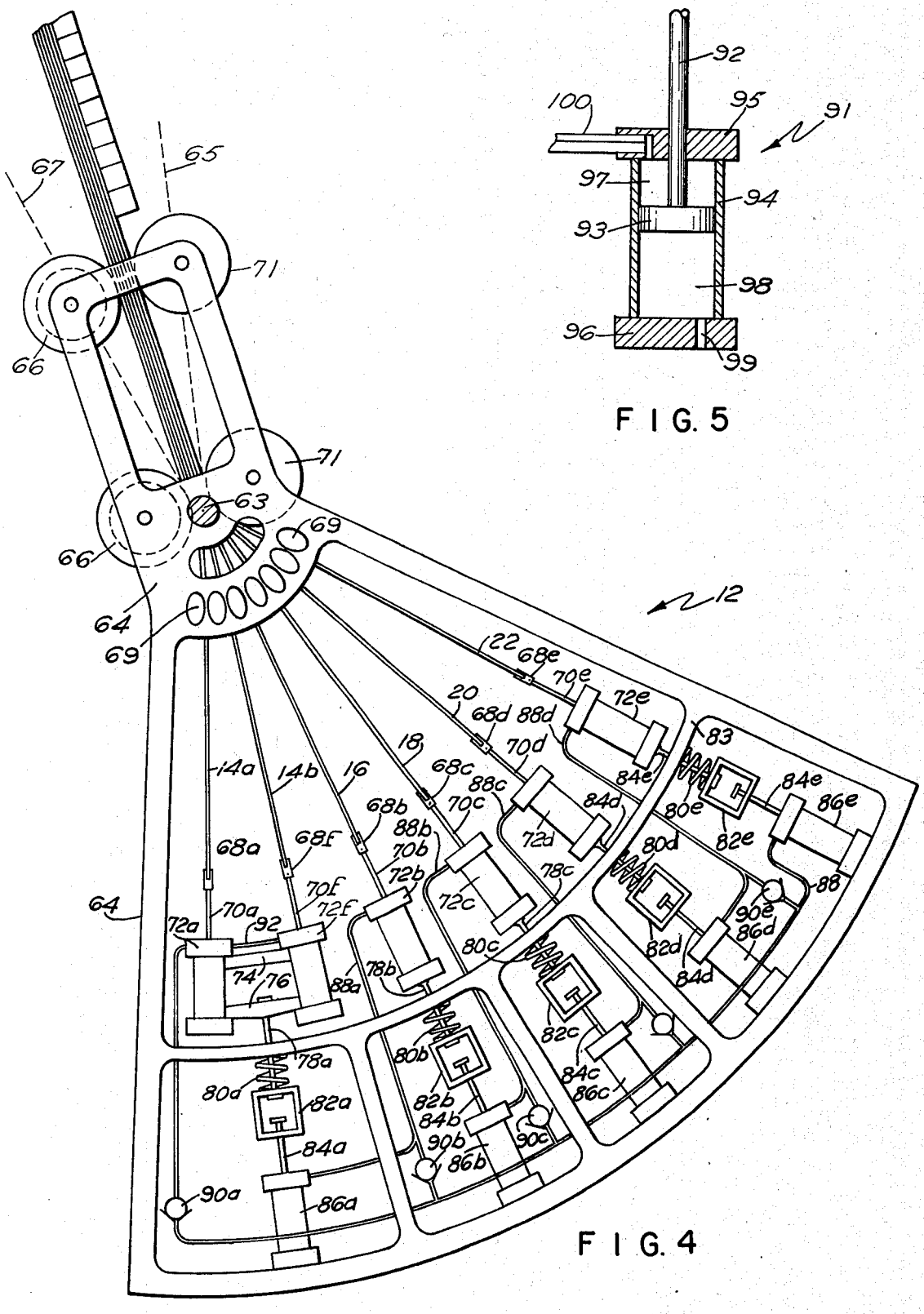
FIG. 4 shows the load distribution mechanism of FIG. 1 and the extension of the strength members of FIGS. 2 and 3.
FIG. 5 shows an individual piston arrangement of the load distribution mechanism of FIG. 4.

FIG. 4 shows the load distribution mechanism 12 that is connected to the towed body 15 of FIG. 1 by means of a journal 63. A ribbed frame 64 forms an enclosure of the mechanism 12. The strength members 14*a*, 14*b*, 16, 18, 20 and 22 orient load distribution mechanism 12 by means of configuration of roller guides 66 and 71. The mechanism 12 pivots about journal 62. The extent of the pivoting is between axes 65 and 67 with the mechanism 12 aligned along axis 65 at light loads and axis 67 at heavy loads. The strength members 14*a*, 14*b* 16, 18, 20 and 22 pass through roller guides 66 and 71 and between bars 69. They are then respectively terminated at one side of connectors 68 *a–f*, inclusive. The connectors 68 *a–f*, are attached on their other side to respective piston rods 70 *a–f*. The rods 70 *a–f*, extend into hydraulic cylinders 72 *a–f*.

Cylinders 72*a* and 72*f* are connected by bar 74 and yoke 76. A rod 78*a* with spring 80*a* rigidly connects yoke 76 to a frame 82*a*. Rods 78 *b–e*, respectively having springs 80 *b–e*, rigidly connect cylinders 72 *b–e*, to frames 82 *b–e*. Rods 78 *a–e* pass through apertures in a plate 83 of frame 64 so as to confine springs 80 *a–e* between plate 83 and respective frames 82 *a–e*. Piston rods 84 *a–e* extend through frames 82 *a–e* to cylinders 86 *a–e*. It is to be noted there is a slot in the bottom of frames 82 *a–e* to enable a sliding motion by piston rod 84 *a–e* with respect to frames 82 *a–e*. Flexible lines 88 *a–d* connect 86*a* to 72*b*, 86*b* to 72*c*, 86*c* to 72*d* and 86*d* to 72*e*, respectively. Cylinder 86*e* has a line 88 connecting to cylinders 72 *a–e* through check valves 90 *a–e* and associated lines. A line 92 connects cylinder 72*a* to 72*b*.

FIG. 5 shows a typical hydraulic cylinder 91 that operates similarly to the eleven piston cylinders within load distribution mechanism 12 of FIG. 4. The hydraulic cylinder 91 has a piston rod 92 with piston 93. The piston 93 moves up and down within cylinder wall 94. An upper cylinder head 95 and lower cylinder head 96 enclose cylinder wall 94. A fluid cavity 97 and an ambient pressure cavity 98 are enclosed. The ambient pressure cavity 98 has a vent 99. A hydraulic line 100 is connected to fluid cavity 97. In operation as piston rod 92 is raised the fluid within cavity 97 and line 100 is pressurized.

Figure 6:
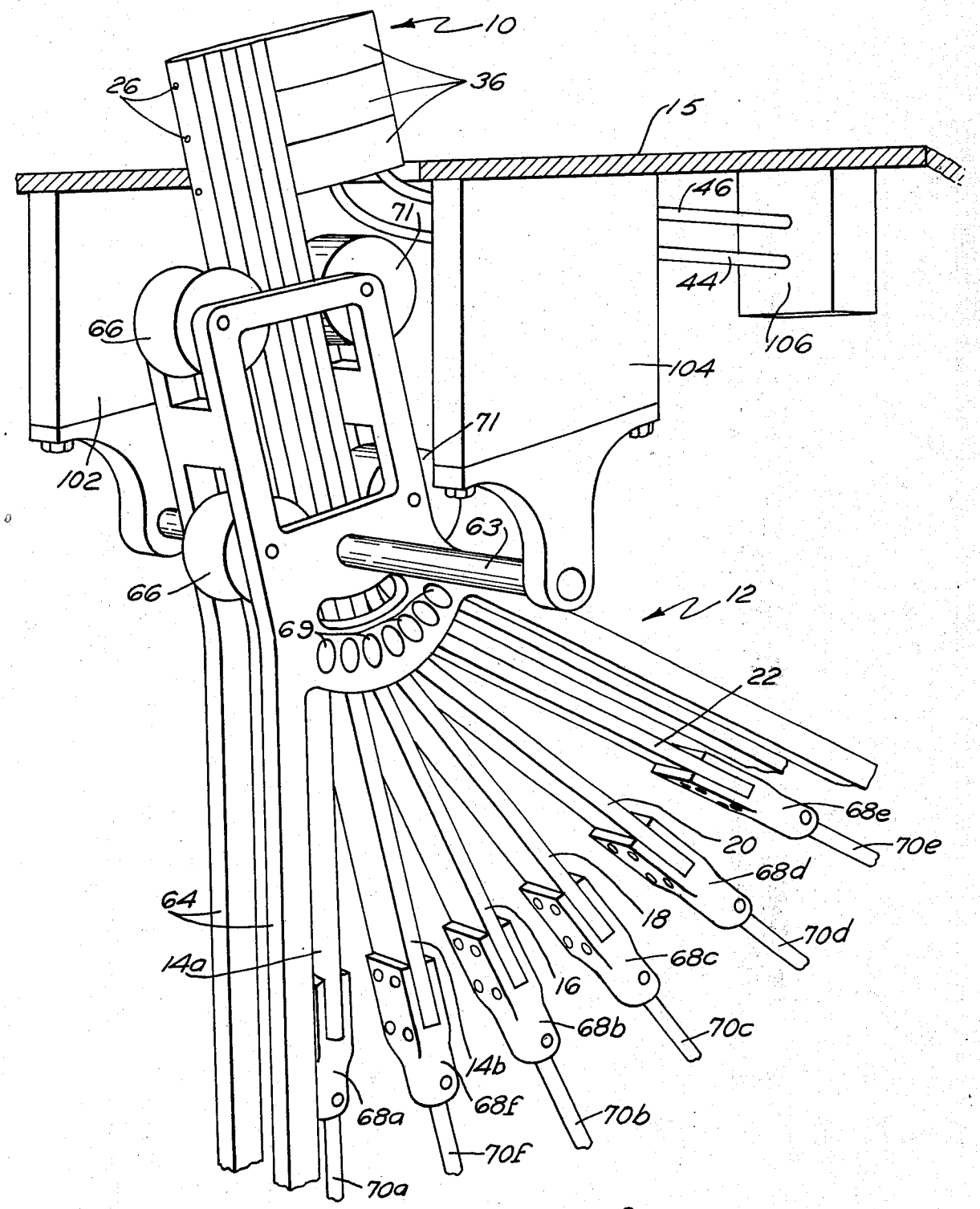
FIG. 6 is an enlarged pictorial representation of the interfacing of the towcable and load distribution mechanism of FIGS. 1–4.

FIG. 6 is a pictorial representation of the connection of load distribution mechanism 12 to towed body 15. The numerical representation is the same in the preceding figures. In addition journal supports 102 and 104 are shown as is electrical junction box 106. The operation of the device is now described with reference to all figures. If a gradually increasing tensile load is applied between towed body 15 and vessel 11, through towcable 10 and distriubution mechanism 12, then at the beginning the entire load would be taken by the forward most strength members 14*a* and 14*b* of towcable 10. Thus initially the center of tension in towcable 10 is well forward of the center of pressure and the towcable 10 is hydrodyamically stable. This initial tensile load is transmitted and undiminished through hydraulic cylinders 72*a* and 72*f*, driving rod 78*a* and frame 82*a* upward to compress spring 80*a*. This divides the load as desired between strength members 14*a* and 14*b*. The frame 82*a* and the piston rod 84*a* with its enlarged head comprise a mechanical clutch which engages when spring 80*a* is compressed a predetermined amount allowing the inside surface of frame 82*a* to contact the lower surface of the base at the upper end of piston rod 84*a*. The rod 84*a* is driven upward compressing the fluid within cylinder 86*a*. The pressure within this compressed fluid is transferred to cylinder 72*b* through line 88*a*. The pressure cannot be transferred through check valve 90*b*. The piston within cylinder 72*b* moves downward gradually applying tension to piston rod 70*b* and strength member 16. This in turn applies tension to rod 78*b*. It can be seen that the previous sequence of events that has just been described is repeated a number of times more until all strength members 14*a*, 14*b*, 16, 18, 20 and 22 have a tensile load applied.

Ultimately, sufficient pressure will be developed in cylinder 86*e* to open check valves 90 *a–e*. At this time pressure in all hydraulic lines and cylinders will be equal. In the present embodiment cylinders 72*a* and 72*f* are so constructed so that they apply only half the pull on each of strength members 14*a* and 14*b* as cylinders 72 *b–e* apply to their respective strength members. Any further increase in the load will now be distributed equally among strength members 16, 18, 20 and 22, and members 14*a* and 14*b* will each receive half as much load. If strength members 16, 18, 20 and 22 have equal capacities and 14*a* and 14*b* have half as much capacity further increases in the load will cause the breaking strength to be reached uniformly. Each strength member will have an equal probability of failing first.

It is to be noted at this time that the components within frame 64 are in a planar arrangement. Confining elements in a single plane facilitates the problem of describing the system and a system constructed in the manner described has advantages as regards accessibility for maintenance, assembly, diagnosing malfunctions, etc. However, if it is desired to tailor a load distribution system to a specific application, consideration must be given to the shape and size of the space that can be made available for the mechanism. Such considerations may mean that while the same components are used in exactly the same manner the frame 64 may be altered so that the mechanism fits into the shape that can be made available.

The reason for using smaller strength members 14*a* and 14*b* in this forward position is that when the towcable 10 bends over a curved surface the first strength members 14*a* and 14*b* bend over the smallest radius and are thus subjected to the largest fiber stress. This stress is increased if the thickness of the first strength member is increased as a result of its having to fit within the narrow fore portion of cable 10. By dividing the first strength member into two thinner members the high bending stress that would have occurred at the aft boundary of a single first strength member is greatly reduced at the aft boundary of the two thinner strength members 14*a* and 14*b*. There has therefore been shown a faired towcable 10 comprising a tandem arrangement of strength members positioned in the forward portion of the fairing. A load distribution mechanism is used to portion a variable load so that the center of tension is maintained as far forward as possible. This is accomplished by utilizing a load distribution mechanism 12 which applies light loads to the first member or members. When a member is safely loaded to some maximum stress any additional load then begins to be applied to the following strength member. This sequence continues until all strength members are loaded to some safe limit. At this time any further increase in load is equally distributed among the strength members so that they approach their breaking strength uniformly.

It will be obvious to those familar with faired towcable design that the subject towcable 10 will become hydrodynamically unstable when the total tensional load increases to such an extent that the center of tension approaches and passes behind the center of pressure. However it is postulated that this instability can be tolerated during those varied circumstances when high tensile loads are applied. The highest tensile loads are expected to be of short duration. These are the so called "impulse loads" or "snap loads" which follow periods of cable slack. These impulse loads are expected to be many times larger than the highest steady state load, the latter being expected at the highest tow speed.

Impulse loads are likely to occur when the tow vessel is forced to proceed at a relatively low speed during high sea states. During times it is expected that the towcable will be relatively straight and vertical. The combination of sea state induced vertical motion and the straight towline are likely to cause the towed sonar to go into a vertical trajectory which is independent of ship motion. The resultant slack cable is a prelude to the impulse load which follows. Towcable instability should be tolerable for those short periods during which a tow system absorbs the energy of an impulse load.

Barring equipment malfunctions there does not appear to be any source that could provide a sustained high tensional load on the cable that is comparable in magnitude to an impulse load. At high speed, hydrodynamic drag forces are expected to bend the towcable into a geometry that tends to smooth out the effects of vertical excursions of both the tow vessel and the towed object.

If a strength member should break the presence of additional strength members provides a chance of saving the tow since the remaining members may be capable of sustaining the load, even if the towcable becomes unstable, for the period of time necessary to slow the tow vessel 11 and retrieve the towed body 15.

The invention can be utilized for a number of different applications where there will be experienced a variable load and where the towcable is located within a moving fluid including liquid and gaseous. Such uses include stays and lines on sailing craft, guys for towers, refueling hoses, structural members and drill piping.

Various alternative components and arangements could be utilized. The distribution mechanism 12 need not be hydraulically operated. It could utilize pneumatic mechanisms, springs or elastomers. The elasticity of the strength members can be varied. Arrangements of sheaves and springs could be used to substitute for the hydraulic system although the performance would not be as advantageous as the specific embodiment shown. The strength members 14*a*, 14*b*, 16, 18, 20 and 22 could have a shallow tongue and grove arrangement to prevent the strength members from sliding laterally.

It will be understood that many additional changes in the details, materials, steps and arrangement of parts, which have been herein described and illustrated in order to explain the nature of the invention, may be made by those skilled in the art within the principal and scope of the invention as expressed in the appended claims.

What is claimed is:

1. A cable comprising:

a plurality of continuous strength members adapted to suspend a body and having respective surfaces abutting and in sliding contact with each other, said strength members aligned in tandem from a forward member to an aft member, each of said members having a plurality of slots spaced a predetermined distance along said members length, said slots of each member being aligned with slots of each of the other members, the size of the slots of each aligned member increasing in longitudinal magnitude in successive order along each of said members from said forward member to said aft member; and fastening means for holding said surfaces in sliding contact with each other.

2. A cable according to claim 1 further comprising: an outer faired surface segmented at predetermined longitudinal spacings;

a plurality of conductors within said faired surface; and a plurality of spacers within said faired surface separating said conductors.

3. A cable according to claim 2 wherein said fastening means includes a rod passing through said slots and fastened to said strength members.

4. A system comprising:

a cable having a plurality of continuous strength members adapted to suspend a body, said strength members having respective surfaces abutting and in sliding contact with each other, said strength members aligned in tandem from a forward member to an aft member, each of said members having a plurality of slots spaced a predetermined distance along said members length, said slots of each member being aligned with slots of each of the other members, the size of the slots of each aligned member increasing in longitudinal magnitude in successive order along each of said members from said forward member to said aft member, said cable further comprising a fastening means for holding said surfaces in sliding contact with each other; and a load distribution mechanism connected to said cable, said load distribution mechanism having loading means adapted for applying a load sequentially to said plurality of strength members when said load exceeds predetermined limits.

5. A system according to claim 4 wherein said load distribution mechanism further comprises:

a plurality of loading terminals respectively connected to said plurality of strength members; and said loading means for sequentially distributing said load at said plurality of loading terminals when said load exceeds predetermined limits.

* * * * *